US005477630A

United States Patent [19]

Tornow et al.

[11] Patent Number: 5,477,630

[45] Date of Patent: Dec. 26, 1995

[54] SPLIT FLAP DISPLAY DEVICE

[75] Inventors: Ralf Tornow; Frank Mössner, both of Berlin, Germany

[73] Assignee: Krone-Rew GmbH, Berlin, Germany

[21] Appl. No.: 109,322

[22] Filed: Aug. 19, 1993

[30] Foreign Application Priority Data

Aug. 20, 1992 [DE] Germany ..... 42 27 881.3

[51] Int. Cl.[6] ..... G09F 11/00

[52] U.S. Cl. ..... 40/475; 40/531

[58] Field of Search ..... 40/475, 466, 476, 40/531; 340/815.61, 815.62; 345/108, 109, 110

[56] References Cited

U.S. PATENT DOCUMENTS 4,060,919 12/1977 Sasaki ..... 40/475 X
4,182,071 1/1980 Todokoro ..... 40/475 X
4,236,334 12/1980 Kimura ..... 40/475 X
4,342,992 8/1982 Bozzini ..... 40/475

*Primary Examiner*—Kenneth J. Dorner
*Assistant Examiner*—Cassandra Davis
*Attorney, Agent, or Firm*—McGlew and Tuttle

[57] ABSTRACT

A split flap display device for displaying changing information of all kinds, where a substantially tool-free, rapid removal of the complete set of flaps is made possible. For this purpose, the rotor unit includes a rotor shaft, two receiving rollers and split flaps. This entire rotor unit is repetitively connectable and disconnectable with a housing of the display device to allow changes in the information displayed.

7 Claims, 3 Drawing Sheets

SPLIT FLAP DISPLAY DEVICE

FIELD OF THE INVENTION

The invention relates to a split flap display device where a plurality of panels are separately displayed to present different information, and in particular to such a display where the entire set of panels can be removed as a unit.

BACKGROUND OF THE INVENTION

Split flap display devices serve for displaying information, such as the quickly changing destinations and times in installations for displaying departure times of trains, ships or aircrafts. In the controlled display devices, the split flaps containing the information must quickly be moved, so to change an announcement in shortest time. The high mechanical stresses of the split flaps and the contact to the environment make continuous maintenance of the split flaps necessary.

A split flap display device of the kind referred to hereinbefore is described in CH-PS 580 315. The display drum provided therein comprises a set of written-on panels. Each panel is pivotably supported, in a special way, at the support positions disposed in the circular parallel disks in the form of a ring. When rotating the drum, the written-on panels are successively flipped over from an upper into a lower display position, like a book. In the disks slots are provided which have the thicknesses of the panels. The panels are inserted into the slots. Individual panels can therefore be replaced.

It is disadvantageous, in the split flap display device, that for maintenance and cleaning purposes, individual panels only can be replaced in a time-consuming and laborious manner.

SUMMARY AND OBJECTS OF THE INVENTION

It is therefore the object of the invention to develop a split flap display device of the kind referred to hereinbefore, which permits a substantially tool-free, rapid removal of the whole set of flaps.

The solution of this object is achieved, according to the invention, by providing the rotor unit, at least two receiving rollers and the split flaps replaceably supported in the housing. Hereby, an easy possibility for quickly replacing all split flaps of a flap set is provided.

In a preferred manner, the device contains a drive and a gear-box. A rotor unit is replaceably attached to the housing. The rotor unit contains a rotor shaft with two receiving rollers mounted on the roller shaft, and a plurality of flaps connected to the receiving rollers. The rotor unit is extractable from a front of the housing, so that replacement of the complete set of split flaps is possible from the written-on or display side.

A side wall has a part connected to the housing and another part connected to the rotor unit. Another side wall contains an intermediate wall with one part connected to the housing and another part connected to the rotor unit. Due to the bipartition of the side wall and of the intermediate wall of the housing, and due to the selected support of the rotor shaft in the side and intermediate portions of the side or intermediate walls, resp., quick removal of the rotor unit including the flaps is possible at the site of the split flap display device for maintenance and/or cleaning purposes. There is not needed any specially trained service personnel and no expensive tool. The rotor unit is removable with a few manipulations only, after a side and an intermediate portion and the run-off profile having been removed.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
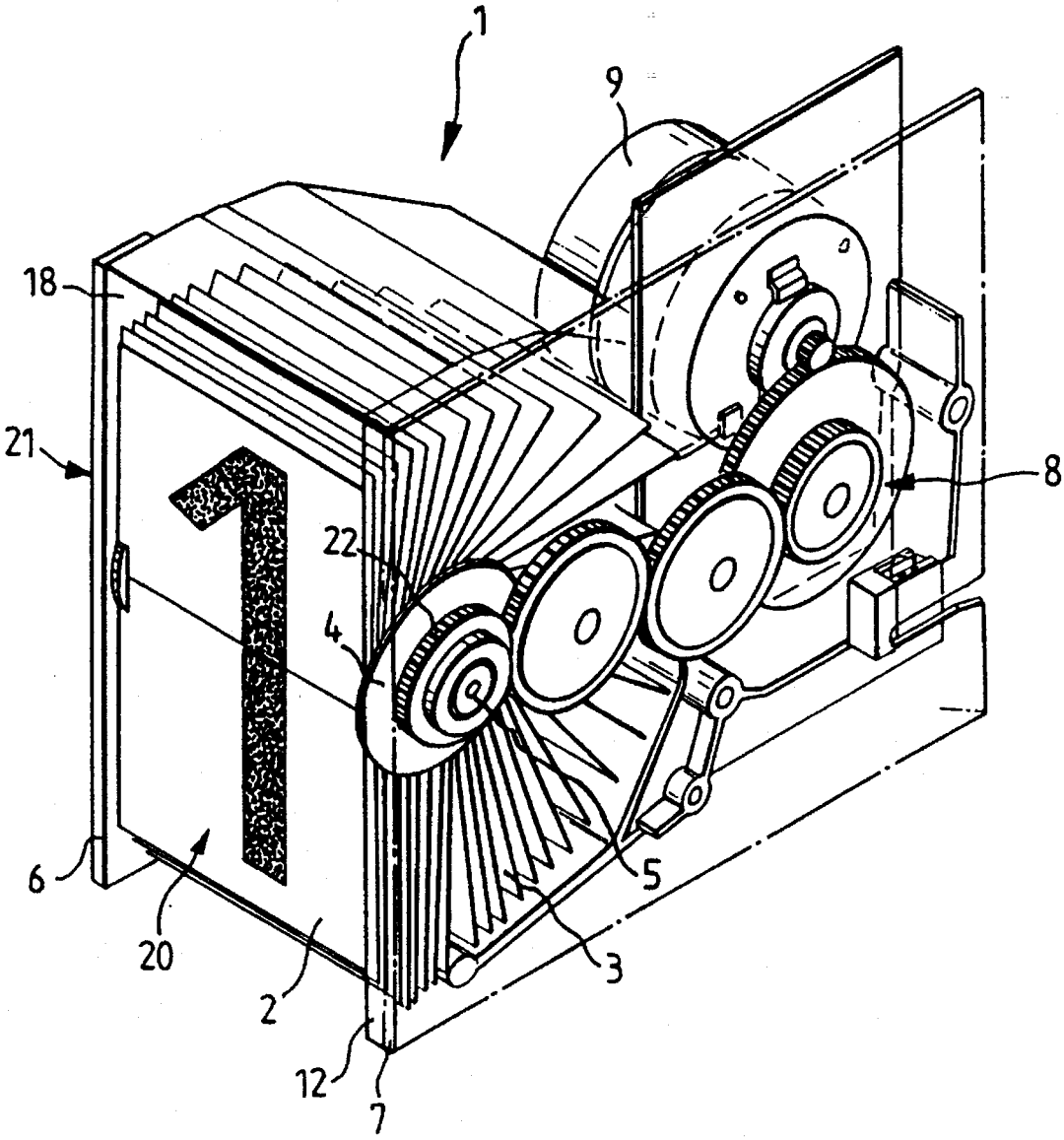
FIG. 1 is a perspective side view of a split flap display module, in an opened-up condition.

The split flap display module 1 is composed of a housing 21 with a set 3 of flaps formed of individual flaps 2. The information is applied to the individual flaps 2 in the form of digits and/or letters. The individual flaps 2 of the set 3 are supported on the two receiving rollers 4 rigidly connected with one another by the rotor shaft 5. The housing 21 is formed of a divided left-hand and of a continuous one-piece right hand side wall 6, 7 and of a run-off profile 18. Ahead of the right-hand side wall 7 and on the inside of the housing 21, a divided intermediate wall 12 is disposed. The rotor shaft 5 is supported in the left-hand side wall 6 and on the right-hand side in the intermediate wall 12, and is connected with a gear wheel 22 providing the connection to a gear-box 8 and a drive 9. The intermediate wall 12 also forms a housing for the gear-box 8. The rotor shaft 5 forms, together with the receiving rollers 4 and the set 3 of flaps, a replaceable rotor unit 20.

Figure 2:
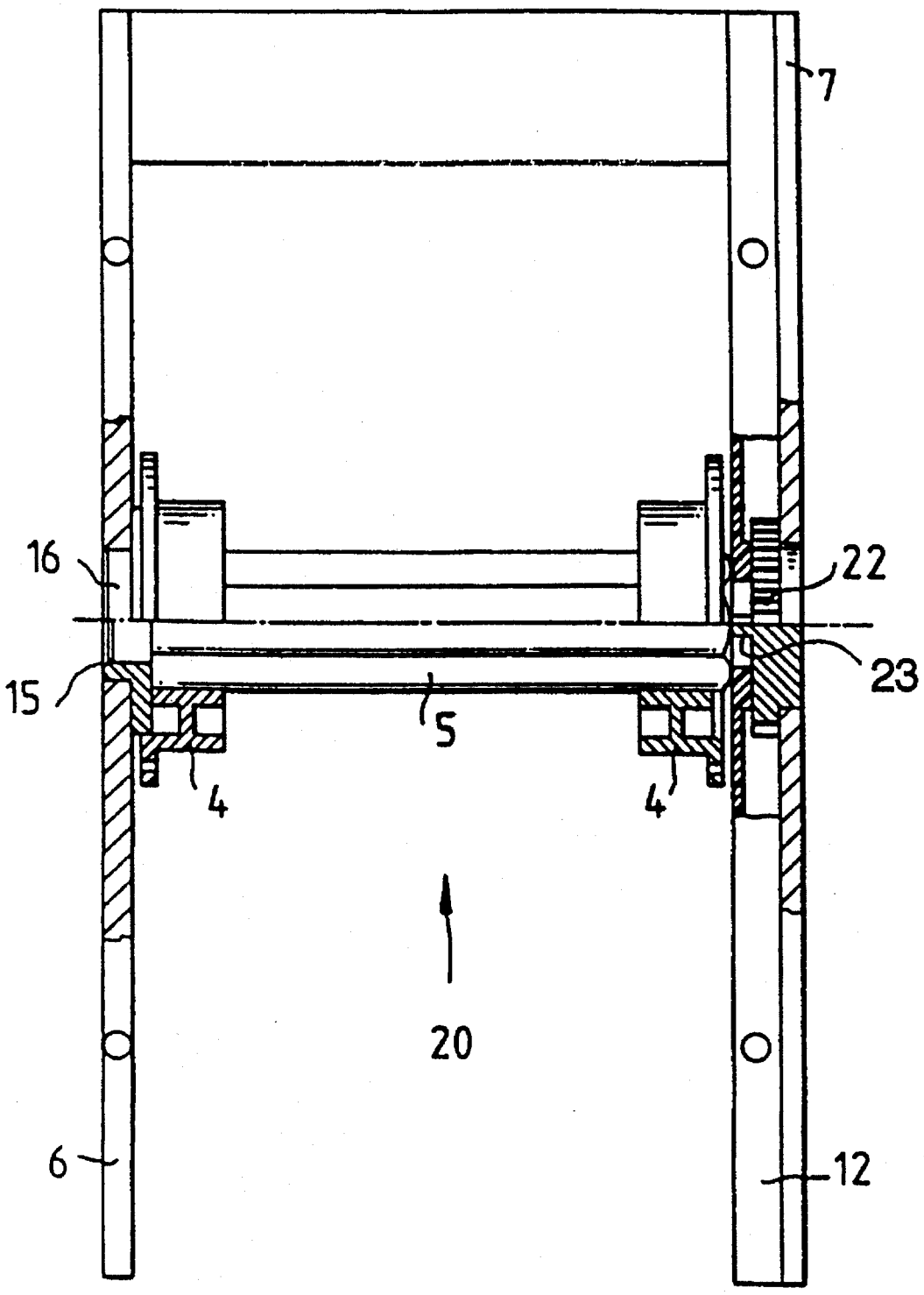
FIG. 2 is a section of the rotor shaft bearing in the side and intermediate walls of the housing.
Figure 4:
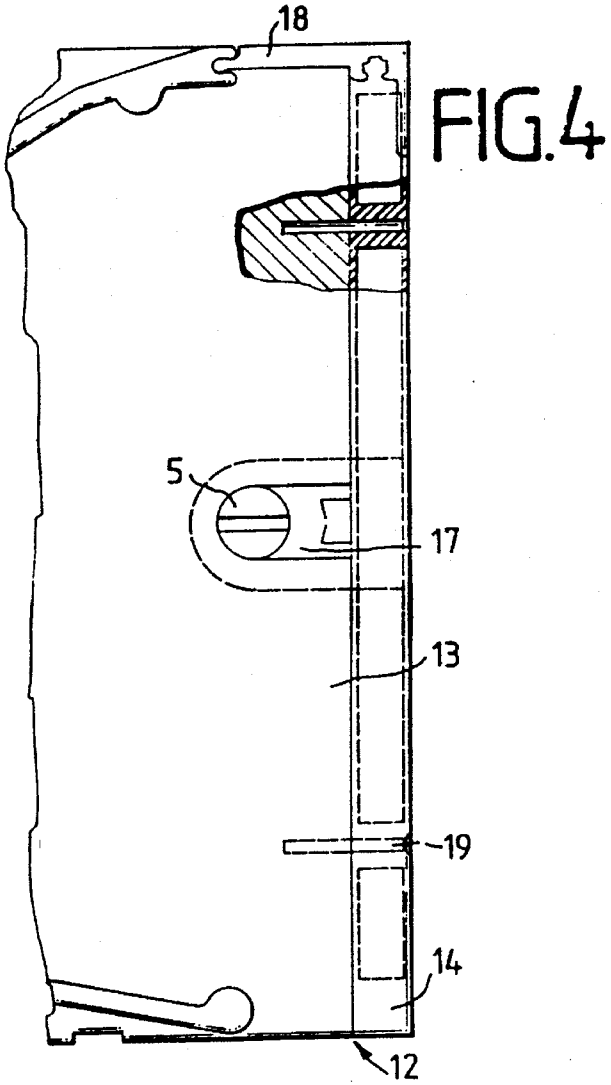
FIG. 4 is a diagrammatical representation of the intermediate wall.
Figure 3:
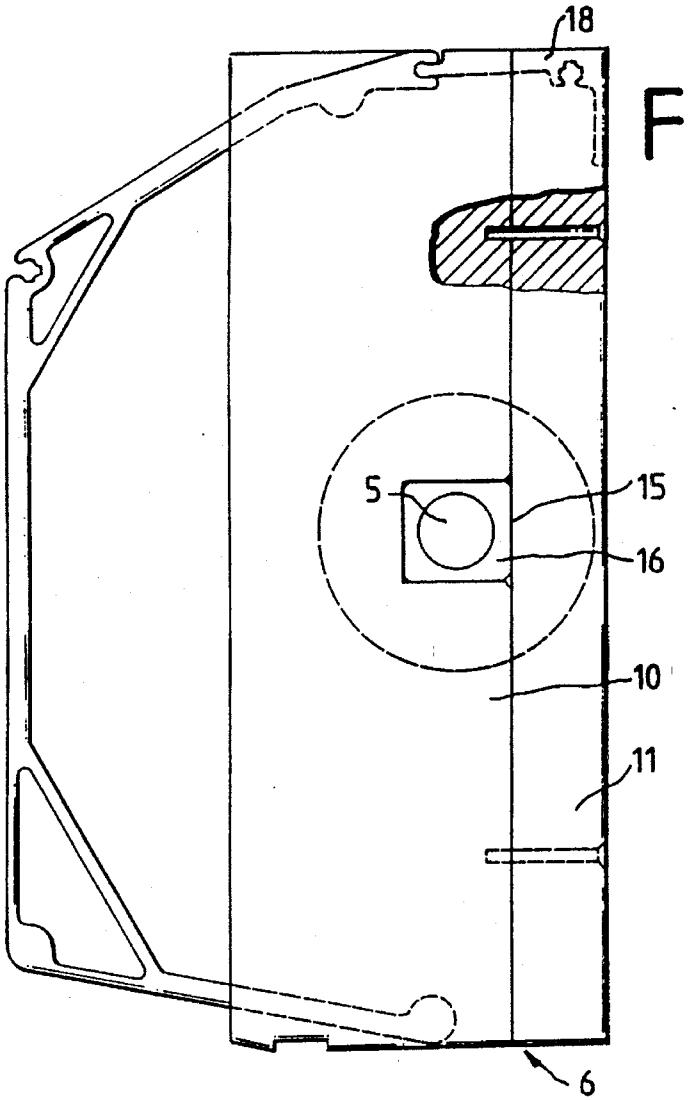
FIG. 3 is a diagrammatical representation of the side wall.

Usually, the split flap display device is formed of several split flap display modules 1 arranged side by side and on top of each other. In order to adapt the rotor unit 20 as a replaceable assembly, the left-hand side wall 6 is vertically divided into the side part 10 and the side part 11 (FIG. 3). Similarly, the intermediate wall 12 is vertically divided into the intermediate part 13 and the intermediate part 14. The side part 10 is provided with a non-rotatable receiving portion 15 for the left-hand bearing 16 of the rotor shaft 5 (FIG. 2). The intermediate wall 12, preferably made from plastic, forms the right-hand bearing 17 (FIG. 4) for the rotor shaft 5. Between the rotor shaft 5 and the gear wheel 22 supported in the right-hand side wall 7, a positively linked coupling is adapted such that the rotor shaft can only be fitted in a defined position. For this purpose, a web 23 is formed on the gear wheel 22, and a corresponding slot is formed on the rotor shaft 5 (FIG. 4). In order to remove the rotor unit 20, the side part 11, the intermediate part 14 and the run-off profile 18 are removed. In the illustrated example, the fixing elements 19 adapted as screws have to be loosened (FIGS. 3, 4). It is also possible, however, to adapt the fixing elements 19 as latching devices. Further, the side part 11, the intermediate part 14 and the run-off profile 18 can be configured as one piece, and can be removed as a whole unit. Then, the rotor unit 20 can be extracted towards the front.

While specific embodiments of the invention have been shown and described in detail to illustrate the application of the principles of the invention, it will be understood that the invention may be embodied otherwise without departing from such principles.

What is claimed is:

1. A split flap display device comprising:

a housing including a display side;

a drive mounted on said housing;

gear-box connected to said drive;

a rotor unit having separation means for replaceably supporting said rotor unit in said housing, said rotor unit including a rotor shaft and two receiving rollers mounted on said rotor shaft, said rotor unit also including a plurality of flaps connected to said receiving rollers, said flaps positioned to display information on said flaps from said display side of said housing, said separation means directly separates and connects an entire said rotor unit from and to said housing from said display side.

2. A split flap display device in accordance with claim 1, wherein:

said rotor shaft is positively linked to said gear-box in a single defined position when said rotor unit is connected to said housing.

3. A split flap display device comprising:

a housing;

a drive mounted on said housing;

a gear-box connected to said drive;

a rotor unit including a rotor shaft and two receiving rollers mounted on said rotor shaft, said rotor unit also including a plurality of flaps connected to said receiving rollers, said rotor unit having separation means for replaceably supporting said rotor unit in said housing, said separation means including a bipartitioned intermediate wall and a bipartion side wall, said rotor shaft being supported on one side in said bipartitioned intermediate wall and supported on another side in a bearing positioned in a non-rotatable receiving portion of said bipartitioned side wall.

4. A split flap display device in accordance with claim 3, wherein:

said intermediate wall is made of plastic.

5. A split flap display device in accordance with claim 3, wherein:

said bipartitioned side wall has one part attached to said housing and another part removable with said rotor unit, said part attached to said housing containing said non-rotatable receiving portion;

said bipartitioned intermediate wall has a part attached to said housing and another part attached to said rotor unit, said part and said another part of said bipartitioned intermediate wall forming a bearing for supporting said one side of said rotor shaft.

6. A device in accordance with claim 3, wherein:

said bipartioned intermediate and side walls are each separatable into two separate parts for replaceably supporting said rotor unit in said housing.

7. A split flap display device comprising:

a housing;

a drive mounted on said housing;

a gear-box connected to said drive;

a rotor unit having separation means for replaceably supporting said rotor unit in said housing, said rotor unit including a rotor shaft and two receiving rollers mounted on said rotor shaft, said rotor unit also including a plurality of flaps connected to said receiving rollers;

a divided side wall having one part attached to said housing and another part another side wall including an intermediate wall, said intermediate wall having a part attached to said housing and another part.

a run-off profile attached to said another part of said divided side wall and said another side wall.

* * * * *